United States Patent [19]

Treen

[11] 4,272,206

[45] Jun. 9, 1981

[54] SAFETY INK PEN

[76] Inventor: J. Paul Treen, 5025 St. Bernard Ave., New Orleans, La. 70119

[21] Appl. No.: 955,804

[22] Filed: Oct. 30, 1978

[51] Int. Cl.[3] ..... B43K 24/06

[52] U.S. Cl. ..... 401/105; 401/116

[58] Field of Search ..... 401/99, 116, 104–106, 401/68, 69, 59, 60

[56] References Cited

U.S. PATENT DOCUMENTS

| | | | |
|---|---|---|---|
| 567,151 | 9/1896 | Moore | 401/99 |
| 1,661,225 | 3/1928 | Kovacs | 401/116 |
| 2,441,280 | 5/1948 | Moore | 401/116 |
| 2,722,914 | 11/1955 | Aversa | 401/105 |
| 2,753,844 | 7/1956 | Boss | 401/116 |
| 3,288,114 | 11/1966 | Ritter | 401/104 |
| 3,289,637 | 12/1966 | Tessler | 401/116 |
| 4,185,933 | 1/1980 | Zepell | 401/31 |

FOREIGN PATENT DOCUMENTS

| | | | |
|---|---|---|---|
| 722976 | 12/1965 | Canada | 401/106 |
| 58050 | 9/1953 | France | 401/104 |
| 1094542 | 5/1955 | France | 401/106 |
| 1351513 | 12/1963 | France | 401/104 |
| 755239 | 8/1956 | United Kingdom | 401/116 |

*Primary Examiner*—William Pieprz

*Attorney, Agent, or Firm*—C. Emmett Pugh & Associates, Ltd.

[57] ABSTRACT

An ink pen is provided which is comprised of an outer rotating and sliding body which fits comfortably, overriding an inner ink containing cartridge. The outer body slides with respect to the inner cartridge when rotated with respect thereto. Rotation of the outer body with respect to the inner cartridge causes the cartridge to retract within the outer body, thus protecting the pocket of an individual upon placement of the pen in such a position when the pen is not in use. Inadvertent placement of the ink pen into a shirt pocket, for example, when the pen is in the writing position, is prevented by means of a projecting clip guard which catches on the outer portion of the pocket, thus preventing the pen from entry into the pocket when it is in its writing position.

7 Claims, 7 Drawing Figures

SAFETY INK PEN

BACKGROUND OF THE INVENTION

1. Field of the Invention

The present invention relates to ink pens, and more particularly relates to retractable ink pens, wherein an inner ink cartridge retracts within the outer body portion of the ink pen upon rotation of the outer body with respect to the top portion of the pen to which the ink cartridge is connected. Even more particularly, the present application relates to a retractable ink pen wherein an exposed clip guard prevents entry of the ink pen into a shirt pocket or the like with the ink pen's writing tip portion is exposed for operation. It should be understood that the term "ink pen" as used herein includes that type of pen commonly known as a "ball point" pen.

2. General Background and Prior Art

Several ink pens are in use today which utilize a retractable ink supply. Such an ink supply can be withdrawn into the inner portion of the ink pen when use of the pen is not desired. Thus, the ink supply and its dispensing tip are hidden from use and the inadvertent dispersing of ink is prevented. This is especially important when the user of the ink pen carries it in a pocket or similar article of clothing, since ink can be dispensed inadvertently into the clothing causing stains and the like.

Several ink pens have been patented which have attempted to solve the problem of the inadvertent dispensing of ink from the pen when not in use.

The following table provides a listing of some prior art devices which have been patented which have attempted to solve the problem of inadvertent ink loss and dispensing as aforementioned.

| Prior Art Patents | | |
|---|---|---|
| U.S. Pat. No. | Inventor(s) | Issue Date |
| 1,566,871 | G.R. Hudson | December 22, 1925 |
| 2,427,069 | R.W. Randolph | September 9, 1947 |
| 2,881,736 | N. Zepelovitch | April 14, 1959 |
| 3,033,167 | K.W. Spillman | May 8, 1962 |
| 3,146,758 | N.A. Zepell | September 1, 1964 |
| 3,181,507 | R.P. Dannebaum | May 4, 1965 |
| 3,344,484 | N.A. Zeppel, et al | October 3, 1967 |
| 3,797,945 | N.A. Zeppel | March 19, 1974 |

One downfall of the devices of the prior art is that the individual can in most cases inadvertently slip or place the ink pen into the shirt pocket or like article of clothing even when the ink pen is in the operative or exposed position when the ink can readily be dispensed onto an item which it touches.

Thus, the individual must be vigilant in order to assure that the ink supply is retracted before placing it into the pocket.

Many prior art retractable ink pens have complex mechanical parts which can become broken or inoperative, thus rendering the ink pen useless.

3. General Discussion of the Present Invention

The present invention provides a retractable ink pen which has means thereon for preventing the inadvertent placement of the ink pen into a shirt pocket or like article of clothing while the ink pen is in its operative or ink dispensing position. The present invention also provides a simple mechanical operating ink pen which easily and positively retracts the ink supply to the inner portion of the ink pen when not in use. The device uses only one moving part, thus minimizing the problem of breakage, or non-operability seen so often in complex mechanical ink pens of the prior art. Likewise, the simple construction of the ink pen of the present invention makes it inexpensive to manufacture.

The inner ink cartridge and outer sleeve are substantially closely associated, so that no wobble is seen. The larger diameter of the ink reservoir prevents clogging common to many small diameter ink pens. The device can be provided with a shorter overall distance between clip guard and writing end of the pen to prevent the pen from "bottoming out" in a shirt pocket with a resultant inking or puncture of the pocket itself. A greater clearance between the ink pen's point and the end portion and greater retraction of the point within the ink pen's body prevent inking of the pocket due to the accumulation of inking matter and inky matter transfusing to the bottom of the pen as with other pens. Likewise, the problem of inking on loose threads or lint in the bottom of the pocket is prevented.

There can further be provided an eraser on top of the ink pen if desired, although of course an eraser generally is not possible with pens with operating mechanisms on top.

BRIEF DESCRIPTION OF THE DRAWINGS

For a further understanding of the nature and objects of the present invention, reference should be had to the following detailed description, taken in conjunction with the accompanying drawings, in which like parts are given like reference numerals and wherein.

DETAILED DESCRIPTION OF THE PREFERRED EMBODIMENT

Figure 2:
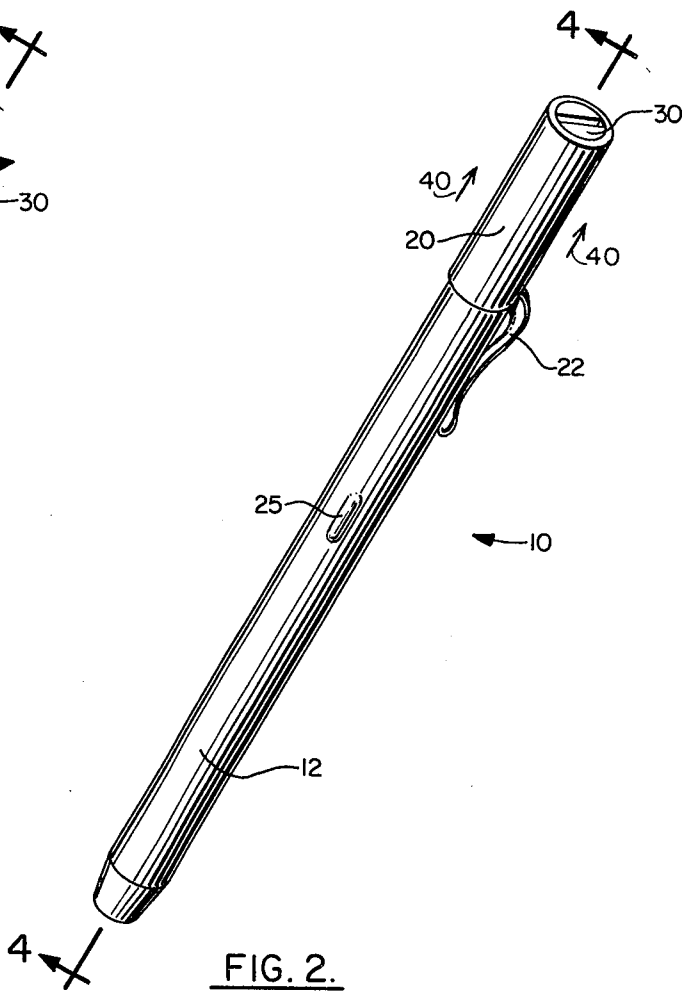
FIG. 2 is a perspective view of the preferred embodiment of the ink pen of FIG. 1 shown in the non-operative retracted position.
Figure 3:
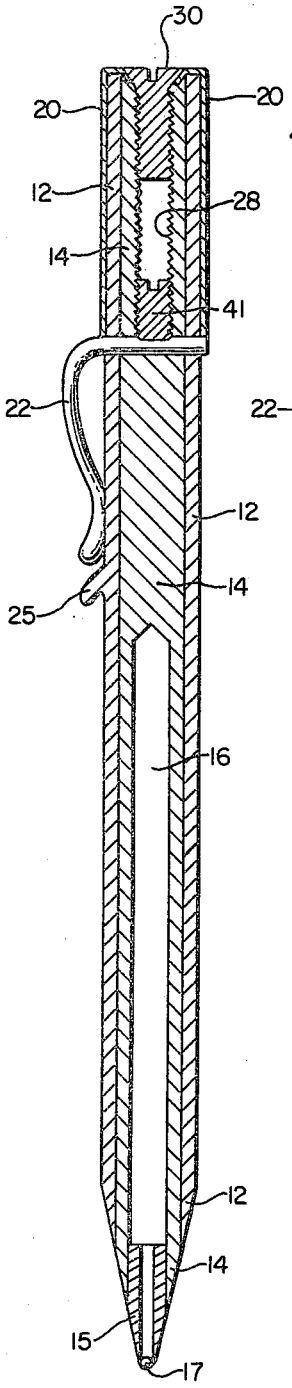
FIG. 3 is a sectional view taken along lines 3—3 of FIG. 1.
Figure 4:
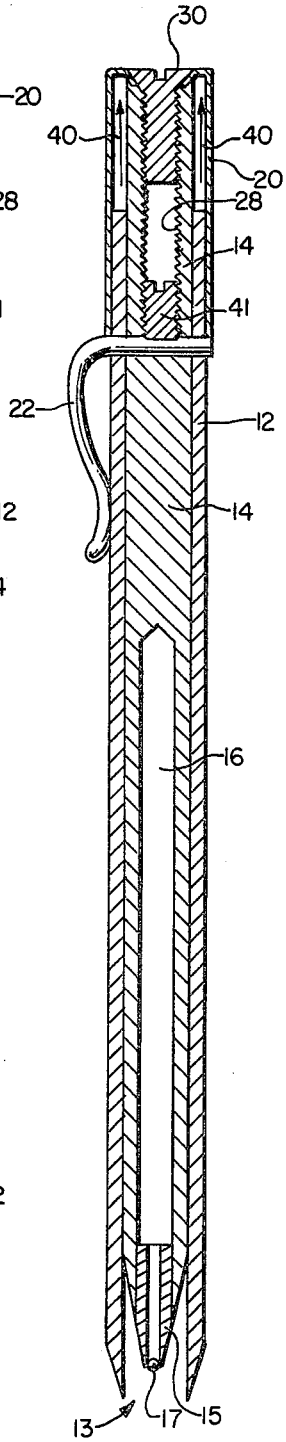
FIG. 4 is a sectional view taken along lines 4—4 of FIG. 2.

The preferred embodiment of the apparatus of the present invention is designated generally by the numeral 10 in FIGS. 1–4. As can best be seen in FIGS. 1–4, ink pen 10 provides an outer body 12 protectively covering an inner ink dispensing cartridge 14. Ink cartridge 14, as can best be seen in FIGS. 3 and 4, is provided with an ink supply 16 which communicates with and dispenses ink through writing tip 15. Such a writing tip 15 can be for example provided with a ball point 17, as is known in the art.

Assembly of ink pen 10 is effected by the entry of ink cartridge 14 into outer body 12, which outer body has an inner bore of substantially identical internal diameter to the outer diameter of ink cartridge 14. The tolerances between these two items can be such that the rotation of inner ink supply cartridge 14 with respect to outer body 12 is easily achieved by an individual, but does meet with some "drag" so as not to be a sloppy and loose fit. Internal portions of outer body 12 can be inwardly deformed slightly to eliminate wobble without close tolerances.

When cartridge 14 is inserted into body 12, clip 22 can be inserted therethrough as is shown in FIGS. 3 and 4. Clip 22 provides a resilient clip which can be used to affix the ink pen to the interior portion of a shirt pocket or the like. Clip 22 is locked in by screw 41 which fits into clip 22, preventing rotation and shifting.

Figure 7:
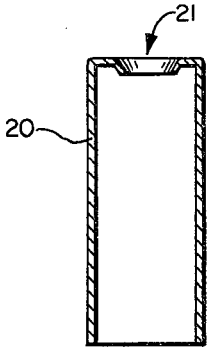
FIG. 7 is a sectional view of the top portion of FIG. 6.

A top portion 20 (note FIG. 7) is placed over the upper portion of outer body 12, and is provided with recesses 19 which cooperate and lock over clip 22. Top 20 is also provided with an upper opening 21 which can be beveled, for example, as is shown in FIG. 7. The beveling of opening 21 provides a seat into which assembly screw 30 can be comfortably placed so as to be flush upon assembly (note FIGS. 3 and 4). Assembly screw 30 can be for example a conventional countersunk type screw as is illustrated shown in FIGS. 3 and 4.

The inner portion of ink cartridge 14 can be provided with upper threads 28 to correspond to the threads of screws 30 and 41, and thus provide an easy fit therefore, or a self-tapping screw can be used.

From the above, it can be seen that once the ink pen is assembled, as described above, ink cartridge 14, clip 22, top 20, and assembly screws 30 and 41 are integrally connected together and can not move with respect to each other. To the contrary, these integrally connected parts move with respect to outer body 12 which slides and rotates with respect thereto (note direction arrows 35 and 40 in FIGS. 1 and 2).

Figure 5:
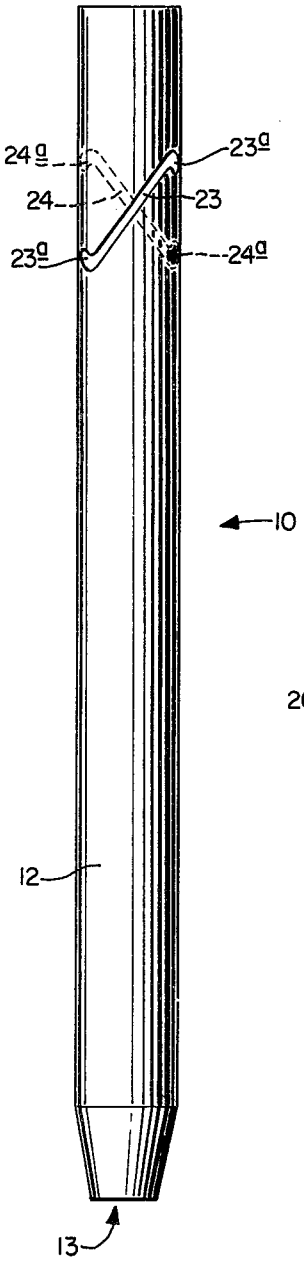
FIG. 5 is a front, elevational view of the outer body portion of the preferred embodiment of the ink pen of the present invention.
Figure 6:
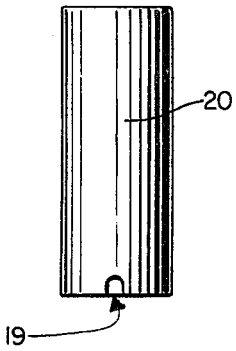
FIG. 6 is a front, elevational view of the top portion of the ink pen of FIGS. 1–4.

From an inspection of FIG. 5, there can be seen a pair of diagonally cut tracks 23, 24 provided in outer body 12. These tracks are of a width approximately the cross sectional thickness of clip 22, and channel its movement therethrough upon rotation of outer body 12 with respect to the remaining integrally connected portions of ink pen 10. Thus it can be seen from the above that rotation of outer body 12 with respect to clip 22 will produce a reciprocation or sliding of outer body 12 with respect to clip 22 and its connected inner ink cartridge 14, which action operates to retract and extend the inner operative ink cartridge 14 and its dispensing tip 15.

The extended and retracted positions of ink cartridge 14 with respect to outer body 12 are illustrated by FIGS. 3 and 4, respectively. Clip 22 can be any resilient type material such as steel, plastic, aluminum, or the like. In the embodiment shown in FIGS. 3 and 4, the clip extends throughout the diameter of ink pen 10, its projection therethrough providing portions of clip 22 which ride in tracks 23 and 24 respectively at opposite sides of barrel 12 (note FIGS. 3–5).

Figure 1:
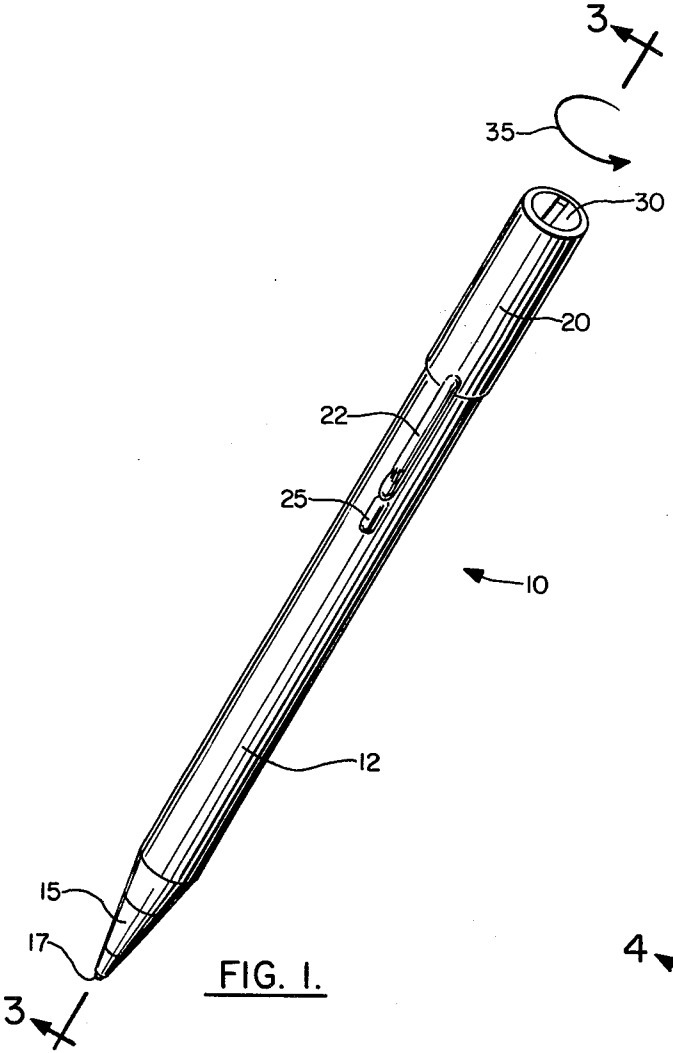
FIG. 1 is a perspective view of the preferred embodiment of the apparatus of the present invention shown in an operative ink dispensing position.

As can best be seen in FIG. 3, the outer body 12 includes a projecting clip guard 25 which blocks the entry into the clip 22 when the pen 10 is in its protracted or extended disposition (note also FIG. 1). Thus, inadvertent placement of the ink pen 10 into shirt pocket, for example, when the pen is in the writing position, is prevented by the projecting guard 25 catching on the outer portion of the pocket, thus preventing the pen 10 from entry into the pocket. However, when the pen 10 is moved into its retracted position (note FIG. 2) the guard 25 is moved down and laterally away from the entry portion of the clip 22, allowing the pen 10 to be clipped to, for example, a shirt pocket.

Tracks 23 and 24 can be provided with recurved end portions *23a*, *24a*, respectively, which provide stops into which clip 22 can rest when ink cartridge 14 is in its completely extended or retracted positions, respectively. These recurved stops (see *23a*, *24a*, FIG. 5) will prevent the ink pen outer body 12 from sliding with respect to ink supply 14 when writing pressure is applied to ink supply 14 with respect to outer body 12, as would be the case in normal operation. Each track 23, 24 is recurved at each end *23a*, *24a* to prevent sliding in either the protracted position (FIG. 1) or the retracted position (FIG. 2). This is to prevent the point 17 from retracting when writing and to prevent point 17 from extending when ink pen 10 is withdrawn from the pocket of the user.

Because many varying and different embodiments may be made within the scope of the inventive concept herein taught, and because many modifications may be made in the embodiment herein detailed in accordance with the descriptive requirements of the law, it is to be understood that the details herein are to be interpreted as illustrative and not in a limiting sense.

What is claimed as invention is:

1. A retractable ink pen, comprising:

a. an outer, longitudinally elongated body having an exterior surface;

b. an inner, ink containing cartridge located within said body, said cartridge being provided with a lower ink dispensing tip portion, said cartridge being movable with respect to said outer body between a first, operative writing position in which said tip portion extends out of said body and a second, non-operative, retracted position in which said tip portion is located within said body;

c. a resilient clip associated with and movable with respect to a portion of said exterior surface of said outer body when said ink cartridge is moved between its operative and non-operative positions, said clip extending over a portion of said body and having an entry end for attaching said ink pen to for example a shirt pocket; and d. movable blocking means fixedly attached to said body and extending radially out from the exterior surface of said body for blocking said entry portion and preventing the attachment of the ink pen to for example a shirt pocket when the tip portion is in its operative position, said blocking means then being located immediately outside of and in front of said entry portion and comprising a radially, exteriorly projecting guard member fixed to said outer body, said guard member being longitudinally aligned with and located right in front of the entry end into said clip when said tip portion is in its operative, writing position but being positioned away from said entry end when the pen is in its non-operative, retracted position, the relative movement of said cartridge with respect to said body simultaneously occurring with the relative movement of said blocking member and said clip.

2. The pen of claim 1, wherein said outer body is provided with at least one diagonal track cooperatively connected to said resilient clip, the camming action of said clip with said track causing said outer body to longitudinally reciprocate with respect to said inner cartridge when said outer body is rotated with respect thereto.

3. The pen of claim 2, wherein rotation of said outer body with respect to said inner cartridge is effected through an arcuate distance, said arcuate distance being defined by a path between operative writing position and at a second inoperative retracted position, said first position being at one end portion of said diagonal track, said first position aligning said resilient clip with said blocking means, and said second position disaligning said clip and said blocking means, and said second position being an inoperative position in which the ink dispensing tip portion of said inner cartridge is retracted within said outer body.

4. The pen of claim 3, wherein each of said track members is provided with stop means for preventing the inadvertent sliding of said outer body with respect to said inner cartridge when said ink pen is in said first position and in said second position.

5. The pen of claim 4, wherein said ink cartridge is provided with a longitudinal annular bore at its upper portion opposite said dispensing tip, said bore being threaded for the reception of an assembly screw thereinto, there being further provided a cap which attaches slidably over the end portion of said outer body and said inner cartridge, said cap having an opening at the upper portion thereof, the assembly of said ink pen being achieved by the insertion of said inner cartridge into said outer bore, and said cap being slidably placed over the upper portion of said outer body opposite said ink dispensing tip at the annular threaded bore, with said screw threadably mounted within said bore, the attachment of said screw to said inner cartridge at said bore effecting a substantially integral non-moving connection between said inner ink cartridge, said screw and said cap.

6. The pen of claim 1, wherein said moveable blocking means and said clip entry portion are moveable sidewardly with respect to and away from one another as said tip portion is retracted, leaving said clip entry portion open when said tip portion is in its retracted position.

7. The pen of either claims 1 or 5 wherein said moveable blocking means and said clip entry portion is moveable longitudinally with respect to and down away from one another a substantial distance as said tip portion is retracted, leaving said clip entry portion open when said tip portion is retracted.

* * * * *